US006199420B1

(12) United States Patent
Bartosch

(10) Patent No.: US 6,199,420 B1
(45) **Date of Patent: *Mar. 13, 2001**

(54) RAM FOR METAL CAN SHAPER

(76) Inventor: Georg Bartosch, 84 Alphine Ct., Demarest, NJ (US) 07627

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/847,923

(22) Filed: Apr. 28, 1997

(51) Int. Cl.[7] ..... B21D 37/12
(52) U.S. Cl. ..... 72/94; 72/456
(58) Field of Search ..... 72/94, 456; 384/42, 384/908

(56) References Cited

U.S. PATENT DOCUMENTS 1,194,038 * 8/1916 Krummel ..... 72/360
2,741,292 * 4/1956 Butters ..... 72/94
3,418,837 * 12/1968 Vanderlaan et al. ..... 72/94
3,446,167 * 5/1969 Armbruster et al. ..... 72/349
4,582,368 * 4/1986 Fujita et al. ..... 384/908
4,773,769 * 9/1988 Church ..... 384/42
5,095,730 * 3/1992 Lauder ..... 72/347

* cited by examiner

*Primary Examiner*—Lowell A. Larson
(74) *Attorney, Agent, or Firm*—Eliot S. Gerber

(57) ABSTRACT

A machine for the forming of the body member of two-piece metal cans uses a carrier upon which are mounted six or more pairs of ram assemblies. The rams are driven by cam action on a fixed track and the rams each carry a pair of wheels which ride on the track. Each of the rams is rectangular in cross-section, to counteract centrifugal force, and is an aluminum alloy coated with a Teflon-ceramic coating so that the ram is light in weight and does not require a liquid lubricant.

4 Claims, 2 Drawing Sheets

RAM FOR METAL CAN SHAPER

FIELD OF THE INVENTION

The present invention relates to the production machines to form metal cans and more particularly to the machines used to form the shape of the bottom and necks of two-piece metal cans.

BACKGROUND OF THE INVENTION

At the present time metal cans are often produced as "two piece cans" which consist of a cylindrical can body with an integral bottom wall and a can top. Millions of such cans are made each day. They are generally made of thin aluminum or steel sheet metal. For example, aluminum cans are used to pack gas pressurized liquids, such as beer and soda. The can must have a certain strength so that it can withstand internal gas pressure as well as the pressures from stacking, dispensing machines and handling. However, thickness of the sheet metal is an important part of the cost of such cans. If the metal may be made thinner, while retaining the required strength, then the cans may be produced at a decreased cost.

One way to obtain can strength, using sheet metal, is to form circular curves in the can bottom. Such curves, viewed from the bottom of the can, are one or more concentric circles in the can bottom and/or can side wall near the bottom. Seen in cross-section, such curves are rounded, generally in a hemispherical shape.

The machine which forms the shape of the can body is sometimes called a "necker". It operates by applying pressure to the can body after it has been formed into its general body shape, e.g., a cylinder or multi-angular shape with an integral bottom wall.

The necker is a type of tool and die in which the sheet metal is placed between the tool, having a protrusion, and the die, having a matching indentation. The tool and die are brought together, under pressure forcing the sheet metal to assume the shape of the protrusion-indentation.

Cans are produced at high speed. For example, the BELVAC (TM Belgium Tool & Die Co.) may form can bodies at the speed of up to 2500 cans per minute. The can bodies are squeezed ("necked") between opposite moving ram assemblies. A series of push rams act as tools and an opposite series of knockout rams act as dies.

The ram assembly can be installed in a rotating drum-shaped component, the turret. The tooling and forming side turrets are rotated at the same speed, so that the can, while engaged in the necking operation, rotates with the turret but is stationary relative to the ram assemblies. A ram assembly has a "bushing" (cylinder), which is a fixed housing, and a ram (piston) which slides within the bushing. The can bodies, as they are progressed through the machine, are rapidly squeezed between a first push ram and a first knockout ram, then a second push ram and second knockout ram, for as many as six or eight pairs of push rams and knockout rams to complete the "necking" operation. Each ram, at its end, has a hard metal disk (ram die) which forms the can's curves.

Each of the rams operates back and forth at high speed and with a travel distance of 1–3 inches. The rams are mechanically operated, as an air pressure or electromechanical solenoid system would be too fragile for the required high pressures and speeds and extreme shock loading. The rams must move with an exact timing, without binding, i.e., ram alignment is critical. If a ram becomes jammed or becomes worn, it may fail and hold up the entire can production system. For that reason the rams are carefully lubricated, inspected and replaced. In older machines the rams were manually lubricated, which was a messy, labor-intensive and time-consuming process. More modern machines use automatic lubrication which involves running grease tubes to each ram. Since the ram assemblies are attached to a turret which rotates, a special coupling for the grease supply line is necessary to distribute the grease to each ram. These couplings often wear out, allowing grease to escape. However, even in assemblies with automatic lubrication, the grease may end up on the can bodies, preventing paint adhesion. No one wants a greasy can of beer. Even with proper lubrication, the rams may have to be inspected and replaced every few weeks, for example, every two weeks in higher speed lines, which is a large expense in terms of parts, machine down-time, the time of skilled labor, and scrapped cans.

The ram pistons are generally round (in cross-section) and have a raised key (elongated protrusion) at its top. The key slides in a key-way (slot) formed in outer body, a bushing-like part. That key and key-way slot system prevents the ram from turning about its axis. However, the key-ram is under considerable sliding pressure and often is the first part of the ram assembly to fail. The ram assembly is made of strong and heavy metals, for example, steel and brass. A ram assembly may weigh 20 to 40 pounds, for example, a typical BELVAC ram assembly weighs about 20 pounds. The piston of the ram assembly, made of steel, itself weighs over 10 pounds. That heavy ram (piston) must be pulled and pushed back and forth rapidly and exactly (in time), which requires a strong machine to operate the cam. The cam is an elongated raised track (rail) which is curved. Each ram (piston) carries, at its rear end, two wheels which fit on opposite sides of the cam track. As the cam track turns it pulls and pushes the wheels causing the ram (piston) to move forward and backwards.

In U.S. Pat. No. 5,467,628, assigned to Belvac Production Machinery, incorporated by reference, a sliding bushing 20 surrounds a ram 22 in a can bottom reprofiler machine. The tail end of the ram carries cam follower wheels 56 which ride against a cam track 57. This general type of double-ram can forming machine is also shown in U.S. Pat. Nos. 4,732,027 and 4,272,977, also incorporated by reference.

SUMMARY OF THE INVENTION

The present invention provides a novel structure for the ram assembly. The ram (piston) is rectangular (cross-section) instead of being round. That shape holds the ram against rotational movement (about its axis) and avoids the use of a key and slot. This shape of ram significantly reduces wear, compared to a round ram with a key and key-way (slot), because it distributes the forces on the entire rectangular area, instead of a small key and key-way. The ram is coated with a special dry lubricant, preferably a Teflon-ceramic (TM of DuPont) coating. No oil or grease is used for lubrication, which avoids grease spilling on the cans and around the machine. The dry lubricant is so wear-resistant that the ram may be used for many weeks without being replaced. The ram assembly (ram and bushing) is formed of an lightweight alloy, e.g., aluminum, so it is relatively light in weight. This imposes less of a strain, and results in less wear, than the heavy brass and steel rams previously employed.

BRIEF DESCRIPTION OF THE DRAWINGS

Other features and objectives of the present invention will be apparent from the following detailed description, taken in conjunction with the accompanying drawings. In the drawings.

DETAILED DESCRIPTION

Figure 2:
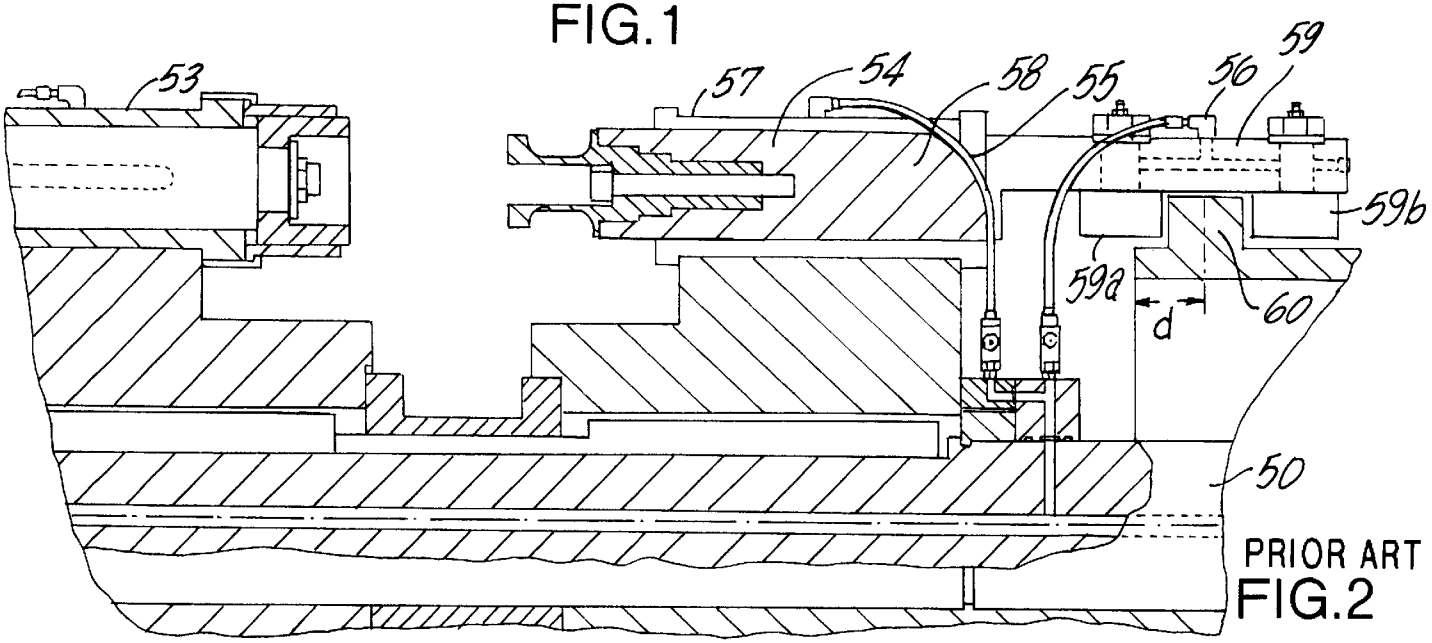
PRIOR ART FIG. 2
FIG. 2 is a front outline view of a PRIOR ART turret to rotate ram assemblies in the necking and bottom forming stages of production.
Figure 3:
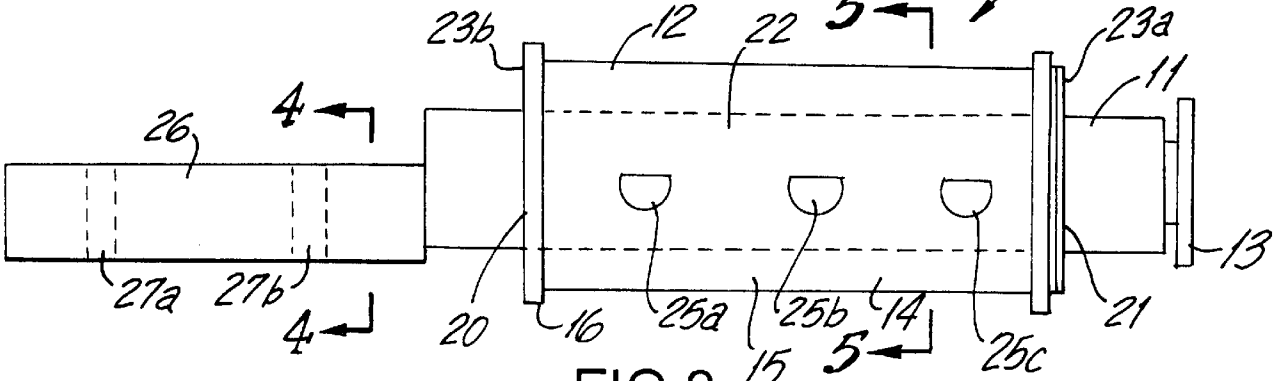
FIG. 3 is a side view of the ram assembly of the present invention.
Figure 6:
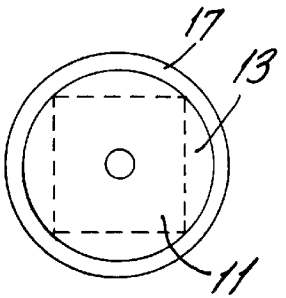
FIG. 6 is a front view of the ram assembly of FIG. 3.
Figure 5:
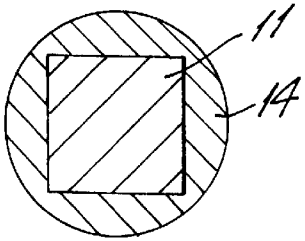
FIG. 5 is a top plan view of the ram assembly of FIG. 3 taken along line A—A.

FIG. 2 shows a side cross-sectional view of a portion of a BELVAC metal can body forming (necking) machine. It typically operates at 120 cans per minute. A central shaft 50 is motor driven and rotates. A casing 51 is fixed to the shaft 50 and rotates with it. A series of ram assemblies are mounted on casing 51. FIG. 2 shows only two opposite ram assemblies 53,54. However, generally the casing 51 will carry six or more (12) pairs of ram assemblies arranged in a semi-circle (in a plane into the paper in FIG. 2). A series of lubrication tubes 55 leads to lubrication nozzles 56. The ram assembly 54 includes a fixed bushing (housing) 57 having a cylindrical bore and a ram (piston) 58. The tail portion 59 of the ram 58 carries two freely rotatable wheels 59*a*, 59*b*. The wheels 59*a*, 59*b* are mounted on opposite sides of a fixed track 60, which is a rectangular elongated protrusion forming a complete circle. The track 60 is fixed and does not rotate. The track 60, at different points in its length, is further advanced (left in FIG. 2) which causes the ram to be extended, or further withdrawn (right in FIG. 2) which causes the ram to be withdrawn, i.e., the distance "d" changes.

Figure 1:
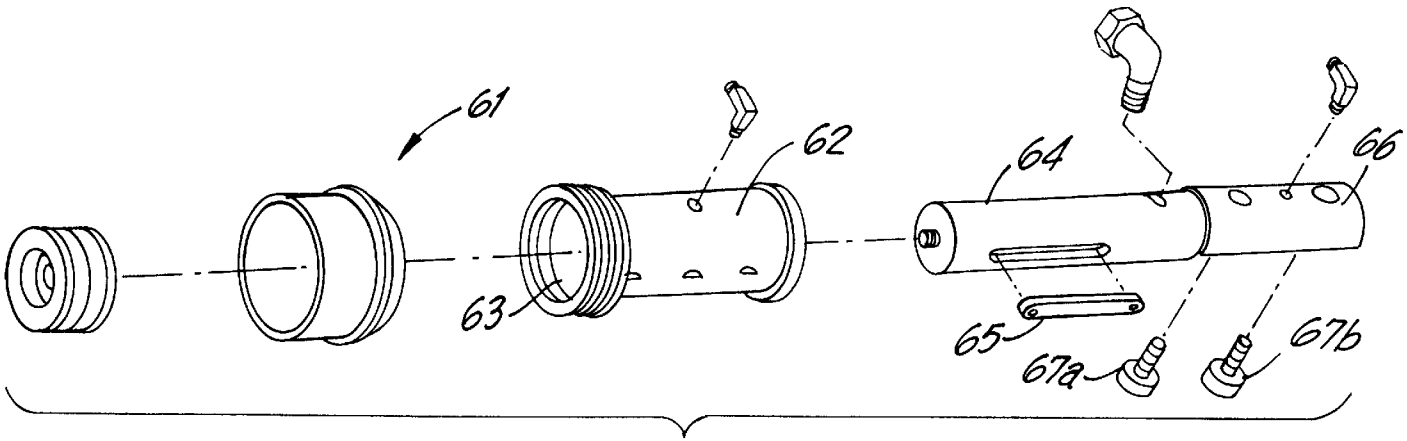
PRIOR ART FIG. 1
FIG. 1 is a perspective and exploded view of a PRIOR ART ram assembly.

FIG. 1 shows a typical PRIOR ART ram assembly 61. The bushing 62 (housing) has a cylindrical bore 63 in which the ram slides therein. The ram 64 has a key 65 (elongated protrusion) which slides in a keyway (key slot) (not shown). The tail portion 66 carries two freely rotatably wheels 67*a*, 67*b*.

The rams are being rotated about the axle shaft 50 at great speed, causing strong centrifugal force. The rams are heavy, generally of brass. The weight of the rams, and the centrifugal force, presents a hostile environment causing rapid wear of the keys, keyways, bushing and rams and presenting difficult problems of lubrication. Often the ram assemblies must be repaired or replaced once a week.

Figure 4:
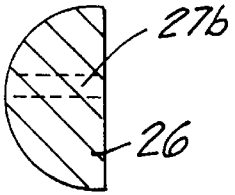
FIG. 4 is a cross-sectional view of the ram assembly of FIG. 3, taken along line B—B.
Figure 4A:
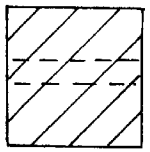
FIG. 4*a* is a rectangular cross-section of an alternative shape of the tail portion of the ram.

As shown in FIG. 4, the ram assembly 10 of the present invention comprises two main members; the ram 11 (piston) and the bushing 12 (housing). Both are preferably made of a strong aluminum alloy such as 7075. The front of the ram 11 has a screw hole into which a bolt 12 is screwed to secure a disk 13 onto the end of the ram. The disk 13 is made of machine tool steel so that it may form millions of can bodies without showing wear.

The bushing 14 has a cylindrical body 15 and two integral flanges 16,17. Each end of the body 15 has a flat rubber gasket 18,19 having a round outer wall and a square hole 20,21. The square ram 11 fits through the square holes 20,21 with a close fit. The gaskets are fixed in place by metal hold-down rings 23*a*, 23*b* which are removably fastened to the bushing 14 by screws.

The interior of the bushing 14 has a bore 22 which is square in cross-sections (perpendicular to the ram's axis). The ram 11 slides in the bore 22 and closely fits in the bore. The top surface of the bushing has three indentations 25*a*–25*c* and the opposite bottom surface also has three similar indentations (not shown) which are used to hold the bushing 14 in place. The rear end (tail portion) 26 of the ram, which is integral with the ram, is half-round (cross-section) in shape and has two holes 27*a*, 27*b* therethrough. These holes are used to removably fasten the end 26 to two rollers which roll on the cam track.

The outer surface of the ram, or at least that portion which is in contact with the bore of the bushing, is coated with a hard dry low-friction coating. The coating is a dry lubricant which preferably is a thin Teflon-ceramic (TM DuPont and available from DuPont), "Teflon" being polytetrafluoroethylene. That coating is preferably about 0.035 inches thick and is bounded to bushing bore 22, as well as to the outer surface of the ram 11. An alternative, but less preferred, coating is a directly applied ceramic or diamond layer or other low-friction layer not requiring a liquid or grease lubricant. The coating may be a thin diamond coating.

U.S. Pat. No. 5,254,141, incorporated by reference, is entitled "Industrial Diamond Coating And Method Of Manufacturing The Same" and discloses adhering a diamond coating to a substrate.

A ram can be formed of other of various industrial materials such as ultra high molecular weight polyethylene, polyamideimide-polyimide, polyimide, phenol, PES (Polyethylene sulfide), PEEK (polyether etherketone) and the like. A coating material for a coating film (a hard material film) which is formed on a slide surface of the ram is selected from diamond, titanium nitride, the above-described Teflon-ceramic material, a nitrite hardened metal surface and the like.

The preferred dimensions of the ram and bearing are as follows:

Shape of cross-section of ram: square

Size of side of ram cross-section: 4 cm

Diameter of bearing (cross-section)

at center along axis: 6.5 cm

Length of ram (square section): 21 cm

Length of ram (tail section): 10.3 cm

Entire length of ram: 31.3 cm

What is claimed is:

1. In a machine for forming the cylindrical body member of a two-piece can in which the body members are formed by being squeezed (necked) between a plurality of pairs of co-acting ram assemblies and not by rotation, the ram assemblies are rotated about a common center on a carrier, each ram assembly includes a bushing attached to the carrier which does not move relative to the carrier and having a bore therethrough, the ram slides within the bore of the bushing along an imaginary axis, each ram having a forward portion and a tail portion which carries two spaced-apart wheels and the wheels are rolled over a fixed cam track so that the ram is thereby pushed forwardly and pulled backwardly and machine tool disk means for forming can bodies, by necking and not by rotation, connected to the forward portion of the ram;

characterized in that the ram is rectangular in shape in cross-sections perpendicular to the axis and has four sides; the bushing is a light weight aluminum alloy; the bore of the bushing is coated with a dry low-friction coating and is rectangular in shape in cross-sections perpendicular to the axis, the bushing encloses the ram on all of its four sides; the ram is a light-weight aluminum alloy coated with a dry low-friction coating, the ram assembly does not have a liquid or grease lubricant line or orifice; the ram assembly is not positioned in a fluid-tight container having a fluid lubricant therein; the machine tool disk means moves forwardly to form can bodies by squeezing (necking); and the machine tool disk means and ram do not rotate relative to the bushing.

2. A machine as in claim 1 wherein the bushing is made of an aluminum alloy.

3. A machine as in claim 1 wherein the coating is a Teflon-ceramic coating.

4. A machine as in claim 1 wherein the rectangular shapes of the ram and bore are squares.

* * * * *